US006011829A

United States Patent [19]

Panasik

[11] Patent Number: 6,011,829

[45] Date of Patent: Jan. 4, 2000

[54] LIQUID COOLED BEARING ASSEMBLY FOR X-RAY TUBES

[75] Inventor: Cheryl L. Panasik, Elburn, Ill.

[73] Assignee: Picker International, Inc., Cleveland, Ohio

[21] Appl. No.: 09/026,709

[22] Filed: Feb. 20, 1998

[51] Int. Cl.[7] ..... H01J 35/10

[52] U.S. Cl. ..... 378/130; 378/132; 378/141

[58] Field of Search ..... 378/130, 144, 378/131, 132, 141; 313/32

[56] References Cited

U.S. PATENT DOCUMENTS

| | | | |
|---|---|---|---|
| 3,942,059 | 3/1976 | Tran-Quang | 313/60 |
| 4,674,109 | 6/1987 | Ono | 378/130 |
| 5,416,820 | 5/1995 | Weil et al. . | |
| 5,535,255 | 7/1996 | Gabbay . | |
| 5,673,301 | 9/1997 | Tekriwal | 378/130 |

*Primary Examiner*—David P. Porta
*Assistant Examiner*—Michael J. Schwartz
*Attorney, Agent, or Firm*—Timothy B. Gurin; John J. Fry; Eugene E. Clair

[57] ABSTRACT

An x-ray tube includes an envelope defining an evacuated chamber in which an anode assembly is rotatably mounted to a bearing assembly and interacts with a cathode assembly for production of x-rays. The bearing assembly includes a bearing housing and a plurality of bearings disposed on an outer surface of the bearing housing. A cooling channel is defined within the bearing assembly and directs cooling fluid such as oil across an inner surface of the bearing housing. As the cooling fluid flows adjacent the inner surface of the bearing housing, heat from the bearing housing is absorbed by the cooling fluid thereby reducing the heat transferred to the bearings.

28 Claims, 4 Drawing Sheets

LIQUID COOLED BEARING ASSEMBLY FOR X-RAY TUBES

TECHNICAL FIELD

The present invention relates to x-ray tube technology. More specifically, the present invention relates to reducing the heating effects on x-ray tube bearings caused by heat dissipated from the anode during operation.

BACKGROUND OF THE INVENTION

Conventional diagnostic use of x-radiation includes the form of radiography, in which a still shadow image of the patient is produced on x-ray film, fluoroscopy, in which a visible real time shadow light image is produced by low intensity x-rays impinging on a fluorescent screen after passing through the patient, and computed tomography (CT) in which complete patient images are digitally constructed from x-rays produced by a high powered x-ray tube rotated about a patient's body.

Typically, an x-ray tube includes an evacuated envelope made of metal or glass which is supported within an x-ray tube housing. The x-ray tube housing provides electrical connections to the envelope and is filled with a fluid such as oil to aid in cooling components housed within the envelope. The envelope and the x-ray tube housing each include an x-ray transmissive window aligned with one another such that x-rays produced within the envelope may be directed to a patient or subject under examination.

In order to produce x-rays, the envelope houses a cathode assembly and an anode assembly. The cathode assembly includes a cathode filament through which a heating current is passed. This current heats the filament sufficiently that a cloud of electrons is emitted, i.e. thermionic emission occurs. A high potential, on the order of 100–200 kV, is applied between the cathode assembly and the anode assembly. This potential causes the electrons to flow from the cathode assembly to the anode assembly through the evacuated region in the interior of the envelope. A cathode focusing cup containing the cathode filament focuses the electrons onto a small area or focal spot on a target of the anode assembly. The electron beam impinges the target with sufficient energy that x-rays are generated. A portion of the x-rays generated pass through the x-ray transmissive windows of the envelope and x-ray tube housing to a beam limiting device, or collimator, attached to the x-ray tube housing. The beam limiting device regulates the size and shape of the x-ray beam directed toward a patient or subject under examination thereby allowing images to be constructed.

In order to distribute the thermal loading created during the production of x-rays a rotating anode assembly configuration has been adopted for many applications. In this configuration, the anode assembly is rotated about an axis such that the electron beam focused on a focal spot of the target impinges on a continuously rotating circular path about a peripheral edge of the target. Each portion along the circular path becomes heated to a very high temperature during the generation of x-rays and is cooled as it is rotated before returning to be struck again by the electron beam. In many high powered x-ray tube applications such as CT, the generation of x-rays often causes the anode assembly to be heated to a temperature range of 1200–1400° C., for example.

In order to provide for rotation, the anode assembly is typically mounted to a rotor which is rotated by an induction motor. The rotor in turn is rotatably supported by a bearing assembly. The bearing assembly provides for a smooth rotation of the rotor and anode assembly about its axis. The bearing assembly typically includes at least two sets of ball bearings disposed in a bearing housing. The ball bearings often consist of a ring of metal balls which are lubricated by application of lead or silver to an outer surface of each ball thereby providing support to the rotor with minimal frictional resistance.

During operation of the x-ray tube, the anode assembly is passively cooled by use of oil or other cooling fluid flowing within the housing which serves to absorb heat radiated by the anode assembly through the envelope. However, a portion of the heat radiating from the anode assembly is also absorbed by the rotor and bearing assembly. For example, heat radiated from the anode assembly has been found to subject the bearing assembly to temperatures of approximately 400° C. in many high powered applications. Unfortunately, such heat transfer to the bearings may deleteriously effect the bearing performance. For instance, prolonged or excessive heating to the lubricant applied to each ball of a bearing can reduce the effectiveness of such lubricant. Further, prolonged and/or excessive heating may also deleteriously effect the life of the bearings and thus the life of the x-ray tube.

One known method to reduce the amount of heat passed from the anode assembly to the bearing assembly is to mechanically secure a heat shield to the rotor. The heat shield serves to protect the bearing assembly from a portion of the heat radiated from the anode assembly in the direction of the bearing assembly. Unfortunately, heat shields are not able to completely protect the bearing assembly from heat transfer from the anode assembly and a portion of the heat radiated will be absorbed by the bearing assembly. Additionally, although the heat shield is useful in preventing some heat transfer to the bearing assembly, the heat shield does not play a role in cooling the bearing assembly of heat already absorbed therein. Further, given that the bearing assembly is enclosed by the rotor, the bearing assembly is not able to easily radiate heat to the cooling fluid contained in the housing as done by the anode assembly. Thus, once heat has been transferred to the bearing assembly, such heat is not readily dissipated.

Therefore, what is needed is an apparatus for reducing the heating effects on x-ray tube bearings caused by heat dissipated from the anode assembly which overcomes the shortfalls discussed above and others.

SUMMARY OF THE INVENTION

In accordance with the present invention, an x-ray apparatus is provided. The x-ray apparatus includes a housing, an x-ray tube disposed within the housing, and means for cooling an interior of the bearing assembly. The x-ray tube includes a cathode assembly having a filament which emits electrons when heated, an anode assembly defining a target for intercepting the electrons such that collision between the electrons and the anode assembly generate x-rays from an anode focal spot, a bearing assembly rotatably supporting the anode assembly, and an envelope enclosing the anode assembly and the cathode assembly in a vacuum.

In accordance with yet another aspect of the present invention, an x-ray tube is provided. The x-ray tube includes an envelope defining an evacuated chamber, an anode assembly rotatably mounted within the evacuated chamber by way of a bearing assembly and operatively coupled with a rotor to provide rotation thereof, and a cathode assembly for generating a beam of electrons which impinge upon the rotating anode assembly on a focal spot to generate a beam of x-rays. The x-ray tube further includes means for reducing heat transfer from the anode assembly to a bearing disposed in the bearing assembly, the means including a cooling channel defined within the bearing assembly for receiving cooling fluid capable of absorbing heat from the bearing assembly.

In accordance with another aspect of the present invention and x-ray tube is provided. The x-ray tube includes an envelope defining an evacuated chamber in which an anode assembly is rotatably mounted to a bearing assembly and interacts with a cathode assembly to produce x-rays. The bearing assembly includes means for directing cooling fluid through the bearing assembly.

In accordance with still another aspect of the present invention, a method of cooling an x-ray tube bearing assembly is provided. The method includes the steps of pumping cooling fluid to the x-ray tube bearing assembly, and directing the cooling fluid through an interior of the bearing assembly.

One advantage of the present invention is that cooling fluid is able to flow within an interior of the bearing assembly thereby allowing for direct cooling of the bearing assembly in regions proximate the bearings.

Another advantage of the present invention is that the amount of cooling may be adjusted by varying the flow of cooling fluid passing through the bearing assembly.

Yet another advantage of the present invention is that direct cooling of the bearings provides for a longer overall x-ray tube life.

To the accomplishment of the foregoing and related ends, the invention then, comprises the features hereinafter fully described and particularly pointed out in the claims. The following description and the annexed drawings set forth in detail certain illustrative embodiment of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE PREFERRED EMBODIMENTS

Figure 1:
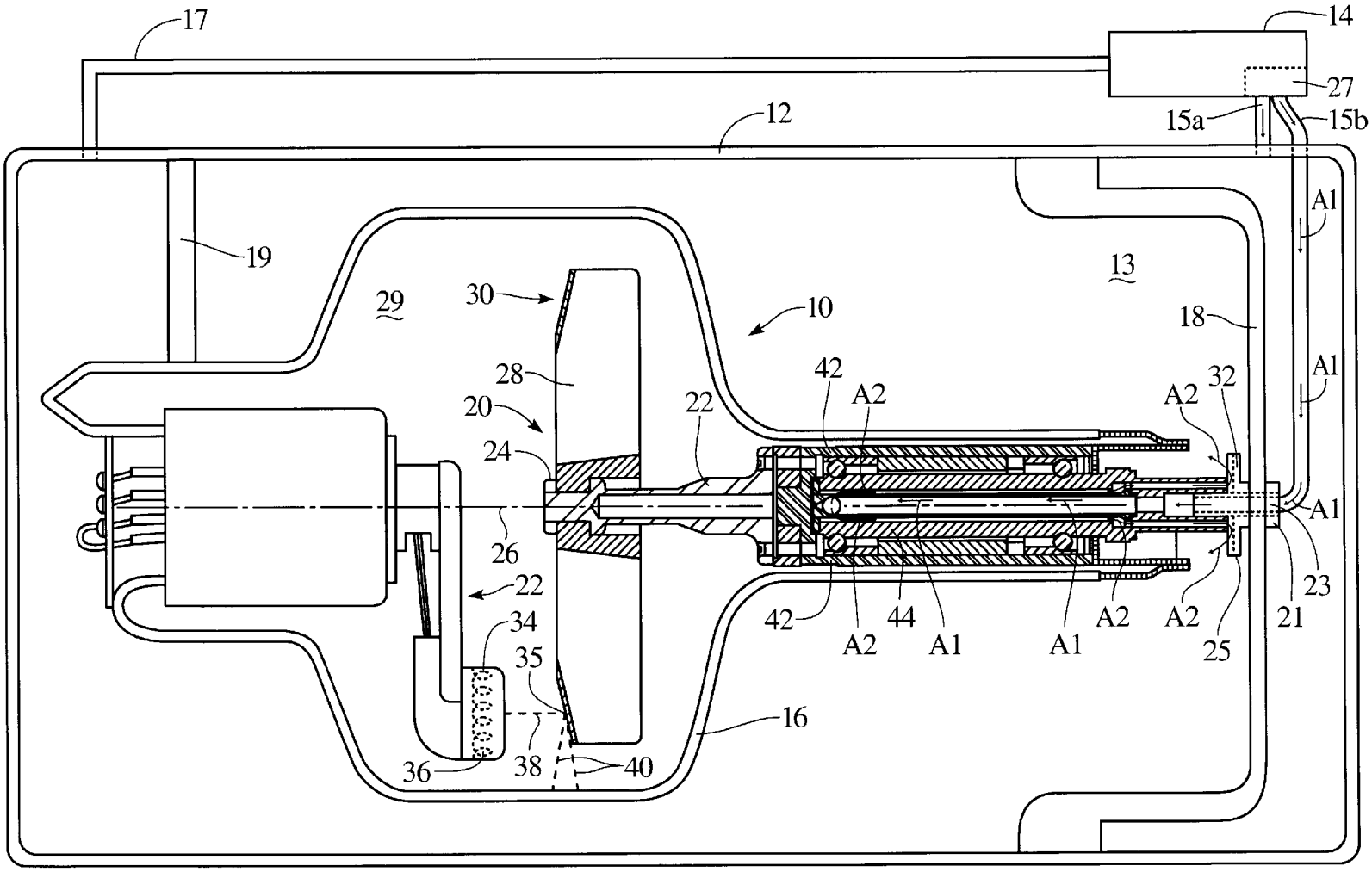
FIG. 1 is a partial cross sectional view of an x-ray apparatus in accordance with the present invention.

The present invention will now be described with reference to the drawings in which like reference numerals are used to refer to like elements throughout.

Figure 2:
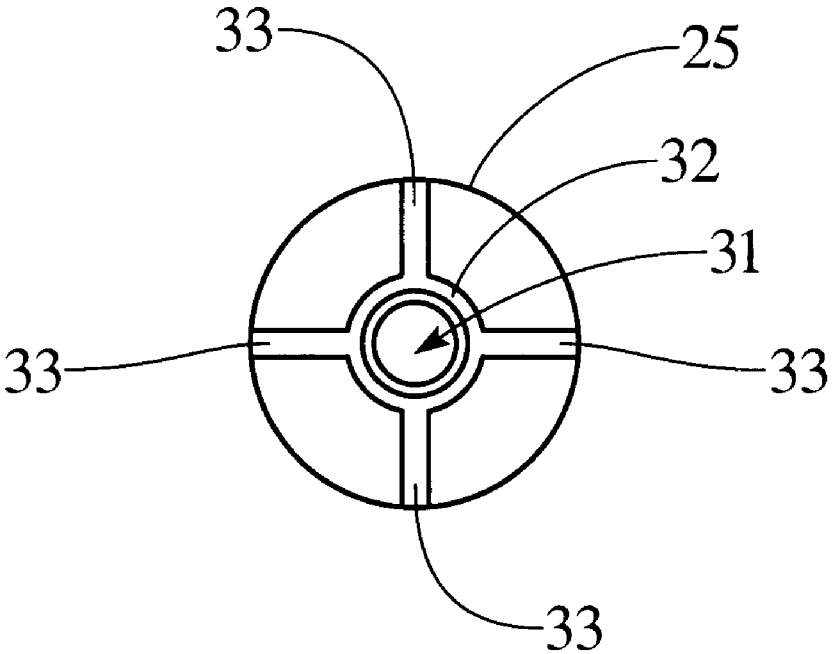
FIG. 2 is a plan view of a spacer of the x-ray apparatus of FIG. 1 showing oil exit slots.

Turning now to FIG. 1, an x-ray tube 10 is mounted within an x-ray tube housing 12. The x-ray tube 10 is mounted within the housing 12 in a predominantly conventional manner by way of an anode bracket 18 and a cathode bracket 19 except that a mounting bolt 21 connecting the x-ray tube 10 to the anode bracket 18 includes an oil inlet bore 23, as is discussed more fully below. A spacer 25 disposed between the anode bracket 18 and the x-tay tube 10 aids in reliably securing the x-ray tube 10 in place. As best seen in FIG. 2, the spacer 25 of the present embodiment includes an aperture 31 sized to receive the mounting bolt 21. The spacer 25 further includes a circular oil outlet groove 32 and four oil exit slots 33 branching off the oil outlet groove 32 to provide a path for oil to be returned to the housing 12 as discussed in more detail below.

The housing 12 defines an oil filled chamber 13 for cooling the x-ray tube 10. In the present embodiment the oil in the housing 12 is a diala oil, however it will be appreciated that other suitable cooling fluid/medium could alternatively be used. The oil within the chamber 13 is pumped through the x-ray tube housing 12 where it flows across an outer surface of an envelope 16 of the x-ray tube 10 so as to absorb heat generated from within the x-ray tube 10 and transfer such heat to a heat exchanger 14 disposed outside the x-ray tube housing 12. The heat exchanger 14 is coupled to the housing 12 by way of inlet valves 15*a*, 15*b*, and outlet valve 17. A mechanical flow regulator 27 within the heat exchanger 14 controls the flow rate of oil through the inlet valves 15*a*, 15*b* as discussed in more detail below. The flow regulator 27 consists of conventional valve controls as is known in the art.

Continuing to refer to FIG. 1, the envelope 16 of the x-ray tube 10 defines an evacuated chamber or vacuum 29. In the preferred embodiment, the envelope 16 is made of glass although other suitable material including other ceramics or metals could also be used. Disposed within the envelope 16 is an anode assembly 20 and a cathode assembly 22. The anode assembly 20 includes a circular target 28 having a focal track 30 along a peripheral edge of the target 28. The focal track 30 is comprised of a tungsten alloy or other suitable material capable of producing x-rays when bombarded by electrons. The cathode assembly 22 is stationary in nature and includes a cathode focusing cup 34 positioned in a spaced relationship with respect to the focal track 30 for focusing electrons to a focal spot 35 on the focal track 30. A cathode filament 36 (shown in phantom) mounted to the cathode focusing cup 34 is energized to emit electrons 38 which are accelerated to the focal spot 35 to produce x-rays 40.

The anode assembly 20 is mounted to a rotor stem 22 using securing nut 24 and is rotated about an axis of rotation 26 during operation. The rotor stem 22 is connected to a rotor body 42 which is rotated about the axis 26 by an electrical stator (not shown). The rotor body 42 houses a bearing assembly 44 which is discussed in more detail below.

Referring now to FIGS. 3–6, the bearing assembly 44 of the present invention is shown in more detail. The bearing assembly 44 includes a cylindrically hollow bearing housing 46 having an inner surface 47 (FIG. 5) and an outer surface 50. The outer surface 50 of the bearing housing 46 defines a pair of inner races 52*a*, 52*b* in which ball bearings 48*a*, 48*b* are respectively situated. Corresponding outer races 54*a*, 54*b* for the ball bearings 48*a*, 48*b* are defined on an inner surface of the rotor body 42. Each bearing 48*a*, 48*b*, is comprised of multiple metal balls made of high speed steel and coated with a lead or silver lubricant to provide for reduced frictional contact. Of course, other suitable bearings made of alternative materials may also be used.

Figure 3:
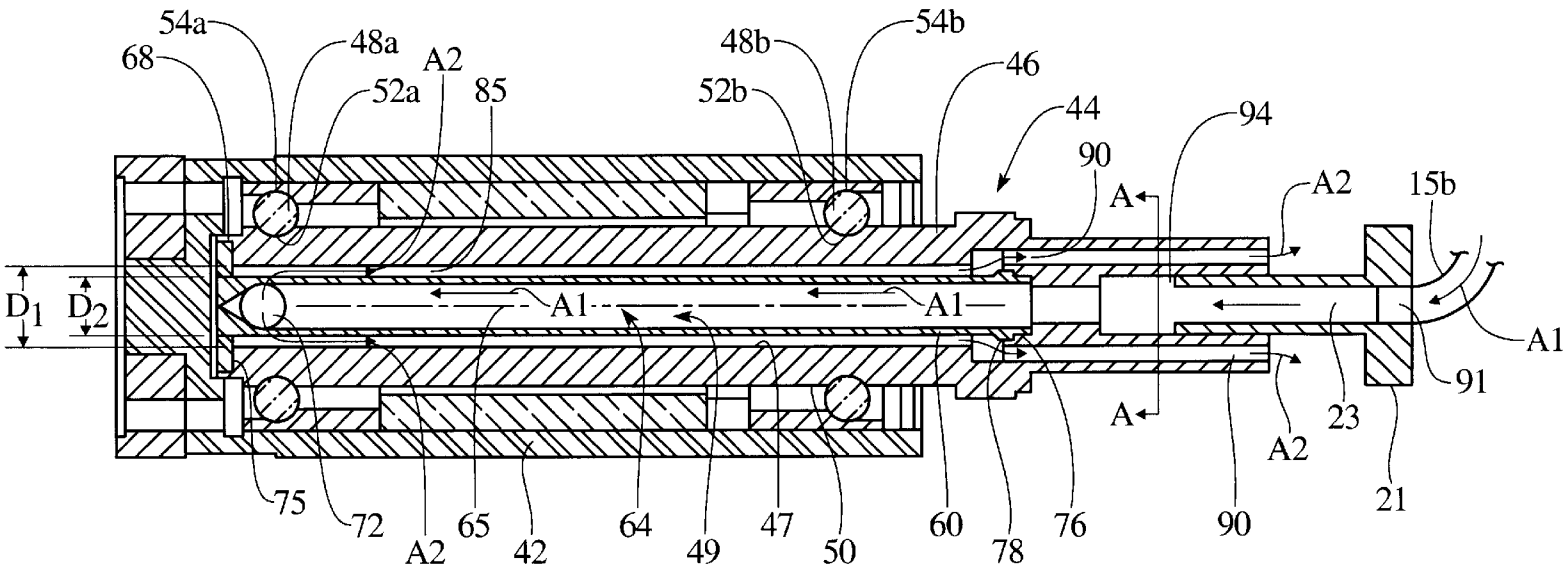
FIG. 3 is an enlarged cross sectional view of a bearing assembly of the x-ray apparatus of FIG. 1.
Figure 5:
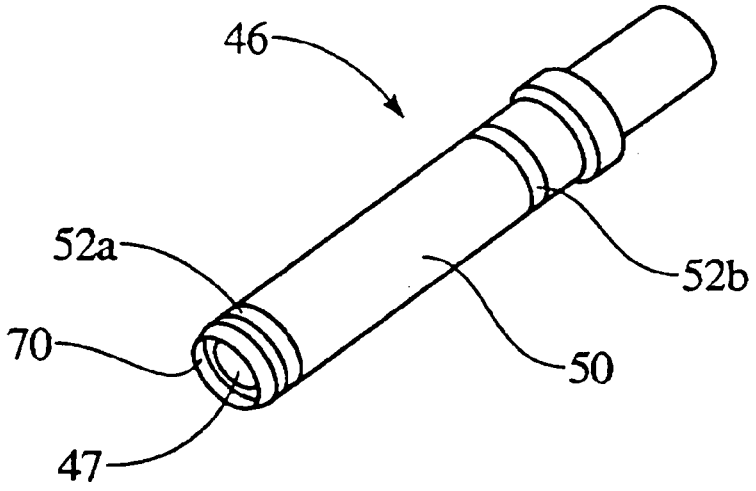
FIG. 5 is an isometric view of a bearing housing of the bearing assembly of FIG. 2.
Figure 6:
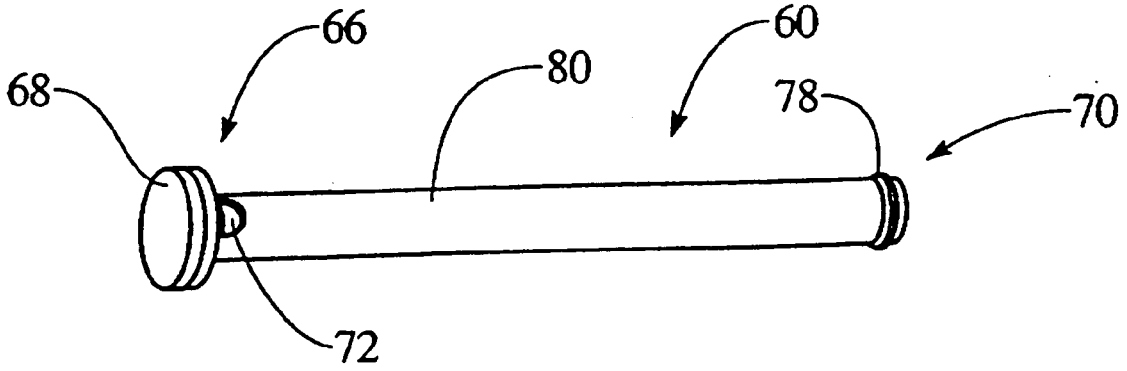
FIG. 6 is an isometric view of a cooling shaft of the bearing assembly of FIG. 2.

Disposed within the bearing housing 46 is an inner cooling shaft 60 (FIGS. 3 and 6). In order to secure the cooling shaft 60 within the bearing housing 44, the bearing housing 44 includes a pair of receiving cavities 75, 76. The receiving cavity 75 is sized to receive a disc shaped cap 68 defined at a first end 66 of the cooling shaft 60. The receiving cavity 76 is sized to receive a circular flange 78 defined along an outer surface 80 of the cooling shaft 60 near an opposite end 70 (FIG. 6) of the cooling shaft 60. The cooling shaft 60 is secured to the bearing housing 44 by way of brazing the cap 68 and flange 78 within the respective cavities 75, 76 of the bearing housing 44. Other methods of securing the cooling shaft to the bearing housing 44 such as diffusing bonding, welding, or other mechanical bonding means could alternatively be used.

The cooling shaft 60 includes a central bore 64 which follows a longitudinal axis 65 of the cooling shaft 60 and provides an inlet for oil to flow into the bearing assembly 44 as is discussed in more detail below. When the cooling shaft 60 is disposed within the bearing assembly 44, the longitudinal axis 65 of the cooling shaft 60 matches the axis of rotation 26 of the anode assembly 20. The central bore 64 originates at the end 70 of the cooling shaft 60 and terminates at a disc shaped cap 68 defined by the cooling shaft 60 at the other end 66. An oil return bore 72 positioned near the end 66 of the cooling shaft 60 is formed in a direction substantially orthogonal to the axis 65 and intersects the central bore 64.

As seen in FIG. 3, an inner diameter D1 of the bearing housing 46 is slightly larger than an outer diameter D2 of the cooling shaft 60. Thus, placement of the cooling shaft 60 within the bearing housing 46 provides for an oil return path 85 to be defined between the inner surface 47 (FIG. 5) of the bearing housing 46 and the outer surface 80 (FIG. 6) of the cooling shaft 60. In the present embodiment, the clearance between the inner surface 48 of the bearing housing 46 and the outer surface 80 of the cooling shaft 60 is 0.05 inches, however, such clearance may be varied based on a desired oil return rate as discussed in more detail below. The central bore 64 and the oil return path 85 define a cooling channel 49 within the bearing assembly 44 which directs oil in a desired manner through the bearing assembly 44 to obtain effective cooling thereof. It will be appreciated that although the present embodiment describes the use of a cooling shaft 60 to define cooling channels 49 for directing the flow of oil within the bearing assembly 44, such cooling channels 49 could be defined in a variety of other ways. For instance, the cooling channels 49 could be integrally molded as a part of the bearing assembly 44, in which case the cooling shaft 60 would not be necessary.

Figure 4:
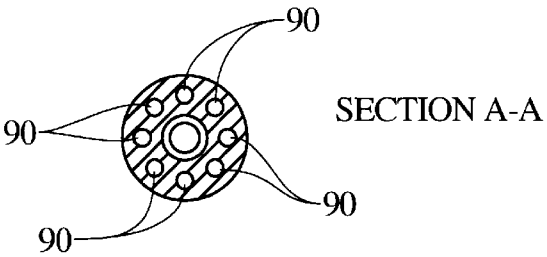
FIG. 4 is a cross sectional slice of the bearing assembly of FIG. 2 taken along section A—A.

Continuing to refer to FIG. 3, the oil return path 85 is extended past the end 70 of the cooling shaft 60 by virtue of eight oil return extension paths 90 defined within the bearing housing 46 (FIG. 4). Each extension path 90 has a diameter of 0.05 inches and serves to provide an outlet for the oil to return to the oil filled chamber 13 within the housing 12. More specifically, each extension path 90 opens into the oil exit groove 32 defined in the spacer 25 (FIG. 2) from which oil returns to the oil filled chamber 13 through one of the oil exit slots 33. Although the present embodiment shows eight extension paths 90, it will be appreciated that other suitable number and sizes of extension paths 90 may alternatively be used depending on the diameter of the extension paths selected and the oil flow rate desired.

Still referring to FIG. 3, the mounting bolt 21 is threaded into a corresponding securing aperture 94 defined by the bearing housing 46 for securing the x-ray tube 10 to the anode bracket 18. As mentioned above, the mounting bolt 21 of the present embodiment includes the oil inlet aperture 23. The inlet aperture 23 is also threaded to allow for an end of the inlet valve 15*b* having a corresponding threaded connector 91 to be secured to the mounting bolt 21 in a reliable manner. Thus, the inlet aperture 23 provides an opening through which oil may flow to the bearing assembly 44 without disturbing the vacuum state of the x-ray tube 10. In the present embodiment, the inlet aperture 23 is 0.08 inches in diameter, however, such diameter may be modified to allow for varied oil flow rates. Unlike conventional x-ray tubes in which oil or other cooling fluid may only contact a small portion of an exterior of the bearing assembly which protrudes from an x-ray tube envelope, the inlet aperture 23 allows oil or other cooling fluid to enter an interior of the bearing assembly 44 whereby such oil is better able to cool the bearings 48*a*, 48*b* as discussed in more detail below.

In operation, oil from the heat exchanger 24 (FIG. 1) is pumped through the bearing assembly 44 so as to allow for direct cooling of the interior of the bearing assembly 44 via thermal conduction. More specifically, oil from the heat exchanger 14 is pumped to the bearing assembly 44 through inlet valve 15*b* in a direction shown by arrows A1. As discussed above, the oil in the inlet valve 15*b* is coupled to the oil inlet aperture 23 of the mounting bolt 21 which provides for passage of the oil to the central bore 64 (FIG. 3) of the cooling shaft 60. The oil pumped into the central bore 64 of the cooling shaft continues in the direction of arrows A1 until such oil reaches oil return bore 72 in the cooling shaft 60. At this point, the oil flows through the oil return bore 72 to the outer surface 80 of the cooling shaft 60, and is directed through oil return path 85 in the direction of arrows A2 which is substantially opposite that of A1.

During passage of the oil through oil return path 85, heat from the bearing housing 46 is absorbed by the oil which in turn reduces the amount of heat transferred by the bearing housing 46 to the bearings 48*a*, 48*b*. By virtue of passing the oil through oil return path 85 along the inner surface 47 of the bearing housing opposite the surface 50 on which the bearings 48*a*, 48*b* are disposed, the oil is able to effectively reduce the temperature of the bearings 48*a*, 48*b* during operation of the x-ray tube 10. Further, by virtue of directly exposing a large surface area of the bearing housing 46 to the oil, heat may be dissipated anywhere along the surfaces of the anode assembly 44 exposed to the oil and thus heat is able to readily pass to the oil and be removed from the bearing assembly 44.

In order to ultimately remove the oil from within the bearing assembly 44, the oil in the oil return path 85 is directed through one of the oil extension paths 90 which serve to return the oil to the oil filled chamber 13 within the housing 12 via the oil outlet groove 32 and oil exit slots 33 defined in the spacer 25 (see FIGS. 1 and 2). As briefly discussed above, the number and size of the oil return paths 85 are selected such that they are collectively able to return the oil to the chamber 13 at the desired flow rate. Therefore, although the present embodiment refers to having eight oil return paths 85 each having a diameter of 0.05 inches, it is equally possible a different number of oil return paths having diameters which allow for a similar overall oil return flow rate. Once in the oil filled chamber 13, the oil is pumped back to the heat exchanger 14 via outlet valve 17 using conventional techniques know in the art.

In order to obtain the desired cooling effects in the present embodiment, the oil passing to the bearing assembly 44 through inlet valve 15*b* is pumped such that the oil has a flow rate of 0.25 gallons per minute (GPM) with a −6 pounds per square inch differential pressure drop (psid). At this oil flow rate and pressure drop, the oil passing through the bearing assembly 44 has the effect of cooling the bearings 48*a*, 48*b* by approximately 100° C. If the oil flow rate were increased in the present embodiment, this would have the effect of further cooling the bearings 48*a*, 48*b*. Similarly, if the clearance in the oil return path 85 were increased, this would also have the affect of further reducing bearing temperature. However, increasing the oil flow rate may require a larger or non-standard pump in the heat exchanger 14 and increasing the clearance of the oil return path 85 or the diameter of the central bore 64 typically requires additional room in the bearing assembly 44 which may not always be available certain x-ray tube configurations. For most typically x-ray tube applications it is expected that an oil flow rate of between 0.1 and 0.4 GPM would be desirous to obtain optimal cooling effects. Thus, it will be appreciated that although the preferred embodiment describes certain dimensions for the chambers through which the oil flows within the bearing assembly 44 and flow rates for the oil, such specifications may be varied to accommodate the needs of a given x-ray tube operation and configuration.

The invention has been described with reference to the preferred embodiments. Obviously, modifications and alterations will occur to others upon reading and understanding the preceding detailed description. For example, although the preferred embodiment describes the oil flowing the direction of arrows A1 and A2, it will be appreciated that the direction of oil flow could be reversed by connecting the eight extension paths 90 to the oil inlet valve 15*b* and allowing the oil inlet aperture 23 of the mounting bolt 21 to open into the oil filled chamber 13. Additionally, rather than pumping oil into the bearing assembly 44, the oil could be left to simply enter the bearing assembly through oil inlet aperture 23 in the mounting bolt 21 and/or extension paths 90 and circulate to and from the heat exchanger 14 along with the remaining oil in the oil filled chamber 13. In such an embodiment, the cooling shaft 60 would not be included in the bearing assembly 44 and there would be no need to pump oil into the bearing assembly through oil inlet valve 15*b*. It is intended that the invention be construed as including all such modifications, alterations and others insofar as they come within the scope of the appended claims or their equivalence thereof.

What is claimed is:

1. An x-ray apparatus comprising:

a housing defining a chamber;

an x-ray tube disposed within the chamber, the x-ray tube including:

a cathode assembly, said cathode assembly including a filament which emits electrons when heated;

an anode assembly defining a target for intercepting the electrons such that collision between the electrons and the anode assembly generate x-rays from an anode focal spot;

a bearing assembly rotatably supporting the anode assembly; and an envelope enclosing the anode assembly and the cathode assembly in a vacuum;

means for cooling an interior of the bearing assembly;

a cooling fluid reservoir;

a cooling fluid return path operatively connecting the reservoir with the chamber;

a first cooling fluid supply path operatively connecting the reservoir with the cooling means; and a second cooling fluid supply path operatively connecting the reservoir with the chamber.

2. The x-ray apparatus of claim 1, wherein the bearing assembly comprises a bearing housing and the means for cooling cools an inner surface of the bearing housing.

3. The x-ray apparatus of claim 1, wherein the means for cooling includes means for directing a cooling fluid through the interior of the bearing assembly.

4. The x-ray apparatus of claim 3, wherein the cooling fluid is oil.

5. The x-ray apparatus of claim 3, wherein the bearing assembly includes a bearing housing and the means for the directing cooling fluid is a cooling shaft disposed within the bearing housing.

6. The x-ray apparatus of claim 5, wherein the cooling shaft includes a cooling fluid inlet bore substantially parallel to a longitudinal axis of the cooling shaft and a cooling fluid return bore substantially orthogonal to the longitudinal axis.

7. The x-ray apparatus of claim 6, wherein a cooling fluid return path is defined between an outer surface of the cooling shaft and the inner surface of the bearing housing.

8. The x-ray apparatus of claim 7, wherein a plurality of oil extension paths couple the cooling fluid return path to the chamber.

9. The x-ray apparatus of claim 1, wherein a fastener secures the x-ray tube to a support structure within the housing and the means for cooling the interior of the bearing assembly includes a cooling fluid aperture defined through the fastener.

10. The x-ray apparatus of claim 9, wherein the fastener is a mounting bolt.

11. The x-ray apparatus of claim 1, wherein the means for cooling the interior of the bearing assembly includes a cooling fluid flow path defined through the bearing assembly.

12. In an x-ray apparatus including a housing for containing cooling fluid, an envelope located within the housing defining an evacuated chamber, an anode assembly rotatably mounted within the evacuated chamber by way of a bearing assembly and operatively coupled to a rotor to provide rotation thereof, and a cathode assembly for generating a beam of electrons which impinge upon the rotating anode assembly on a focal spot to generate a beam of x-rays, the x-ray apparatus comprising:

a first fluid inlet port in fluid communication with the housing;

means for cooling the bearing assembly, said means comprising a cooling channel defined within the bearing assembly for receiving cooling fluid capable of absorbing heat from the bearing assembly;

a second fluid inlet port in fluid communication with the cooling means; and a fluid return port for returning cooling fluid communicated through both of the first and second fluid inlet ports.

13. The x-ray tube of claim 12, wherein the bearing assembly includes a bearing housing for supporting the bearing and at least a portion of the cooling channel is adjacent a surface of the bearing housing.

14. The x-ray tube of claim 13, wherein the cooling channel is adjacent an inner surface of the bearing housing and the bearing is supported on an outer surface of the bearing housing.

15. The x-ray tube of claim 13, wherein the cooling channel is defined by a cooling shaft disposed within the bearing housing.

16. The x-ray tube of claim 13, wherein the cooling fluid is oil.

17. An x-ray tube assembly comprising:

a cooling fluid supply means for supplying a volume of cooling fluid;

an envelope defining an evacuated chamber in which an anode assembly is rotatably mounted to a bearing assembly and interacts with a cathode assembly to produce x-rays; wherein the cooling fluid supply means includes means for directing a portion of the total volume of cooling fluid through the bearing assembly.

18. The x-ray tube of claim 17, wherein the bearing assembly includes a bearing housing and the means for directing cooling fluid is disposed in the bearing housing.

19. The x-ray tube of claim 18, wherein the means for directing cooling fluid directs the cooling fluid across an inner surface of the bearing housing.

20. The x-ray tube of claim 19, wherein a plurality of bearings are disposed on an outer surface of the bearing housing.

21. The x-ray tube of claim 18, wherein the means for directing cooling fluid is a cooling shaft having a cooling fluid inlet bore substantially parallel to a longitudinal axis of the cooling shaft and a cooling fluid return bore intersecting the inlet bore.

22. The x-ray tube of claim 21, wherein a cooling fluid return path is defined between an outer surface of the cooling shaft and the inner surface of the bearing housing.

23. The x-ray tube of claim 18, wherein the cooling fluid is oil.

24. A method of cooling an x-ray tube bearing assembly, comprising the steps of:

supplying cooling fluid to cool the x-ray tube; and directing a portion of the supplied cooling fluid through an interior of the bearing assembly.

25. The method of claim 24, wherein the bearing assembly includes a bearing housing and the cooling fluid is directed across a surface of the bearing housing.

26. The method of claim 25, wherein the cooling fluid is pumped at a rate of between 0.1 to 0.4 gallons per minute.

27. The method of claim 24, wherein the bearing assembly includes a cooling shaft for directing the cooling fluid through the interior of the bearing assembly.

28. The method of claim 24, wherein the bearing assembly is disposed in an envelope defining a vacuum and the vacuum inside the envelope is maintained during the step of directing cooling fluid through the interior of the bearing assembly.

* * * * *